United States Patent [19]

Howard

[11] Patent Number: 4,861,231

[45] Date of Patent: Aug. 29, 1989

[54] LIQUID LEVEL SENSING DEVICE

[76] Inventor: Herbert H. Howard, 20345 Ruston Rd., Woodland Hills, Calif. 91364

[21] Appl. No.: 269,893

[22] Filed: Nov. 10, 1988

[51] Int. Cl.[4] ..... F04B 49/02; H01H 35/30

[52] U.S. Cl. ..... 417/38; 417/44; 200/81 H; 200/505; 4/544

[58] Field of Search ..... 417/38, 36, 40, 44, 417/45; 200/81 H, 50 S; 4/542, 543, 544; 137/390; 69/591

[56] References Cited

U.S. PATENT DOCUMENTS

| | | | |
|---|---|---|---|
| 3,433,249 | 3/1969 | Nelson | 137/390 |
| 3,775,026 | 11/1973 | Hewlings | 417/36 |
| 4,087,204 | 5/1978 | Miedermeyer | 417/38 |
| 4,620,835 | 11/1986 | Bell | 417/38 |
| 4,647,738 | 3/1987 | Diamoand | 200/81 H |

*Primary Examiner*—Leonard E. Smith
*Assistant Examiner*—P. Schevermann
*Attorney, Agent, or Firm*—Noel F. Heal

[57] ABSTRACT

A device for automatically disabling operation of a pneumatic device, such as an air-actuated pump switch. The device includes a diaphragm exposed to atmospheric pressure on one side and to water pressure on the other. So long as the water pressure is high enough, the diaphragm is held in a position in which it seals a pneumatic port and ensures continuing operation of an air-actuated switch. If the water pressure falls below a preselected level, the port is vented to atmosphere and the air-actuated switch is effectively disabled until the water pressure increases again.

3 Claims, 1 Drawing Sheet

LIQUID LEVEL SENSING DEVICE

BACKGROUND OF THE INVENTION

This invention relates generally to the field of spas and hot tubs, and relates more specifically to safety shutoff devices for this type of equipment. Spas and hot tubs present special problems of electrical safety, since they are necessarily operated in a wet environment, by persons who would be subject to serious electrical shock if they came in contact with live electrical wiring. Providing a simple electrical switch for operation of a spa pump motor, and locating that switch out of reach of anyone in the spa, is not a completely safe acceptable solution to the problem. Air-actuated switches have been developed to address this difficulty. These electrical switches are operated pneumatically, by means of a long tube or control line connecting the switch to a manually operated plunger. Depressing the plunger increases the air pressure in the tube, thereby operating the electrical switch. This permits location of the plunger beside the spa, for convenience of operation. Typically, the switch toggles between "off" and "on" positions each time the plunger is depressed. In this manner the electrical circuitry is effectively isolated from the user's wet environment.

Another difficulty with spas and tubs is that they should not be operated if the water is below a preselected level, to avoid damage to pumps and other equipment. Some form of water level sensor is typically used to take care of this difficulty. Water level sensors can be in the form of electrical contacts connected to the electrical circuitry of the pump, but there is again an inherent risk that exposure of any electrical circuitry to the wet environment of the tub may lead to electrical shock.

There is, therefore, a need in the spa and hot tub field for a non-electrical low water level shutoff, preferably one that can be integrated in its operation with an air-actuated pump switch. The present invention is directed to this end.

SUMMARY OF THE INVENTION

The present invention resides in a low-water level disabling device suitable for installation in a control tube used for connecting a manually operated air button with an air-actuated switch. Briefly, and in general terms, the device of the invention comprises a chamber, a bendable diaphragm installed in the chamber and dividing it into first and second chamber sections, means for venting the first chamber section to atmosphere, and means for coupling a water pressure to the second chamber section. The diaphragm is bent toward the first chamber section, to a first position, so long as the water pressure in the second chamber section exceeds a preselected minimum, but assumes a second position bent toward the second chamber section when the water pressure falls below the preselected minimum. The device further includes a pneumatic port, covered by the diaphragm in its first position but uncovered and vented to atmosphere by the diaphragm in its second position. The pneumatic port is in fluid communication with an air-actuated switch, operation of which is disabled by venting of the port to atmosphere.

The bendable diaphragm may be of the snap-action type.

The device of the invention may also be described as comprising an air-filled control line extending between an air-actuated electrical switch and a manually operated plunger, a normally sealed pneumatic port in fluid communication with the control line, the venting of which would disable operation of the switch, a device body, and a bendable diaphragm installed in the device body. The diaphragm is movable between first and second positions, and has one surface exposed to atmospheric pressure, and in sealing contact with the pneumatic port when the diaphragm is in its first position. The device further comprises means for coupling a water pressure to the other surface of the diaphragm. The diaphragm is bent to its first position so long as the water pressure exceeds a preselected minimum level, but assumes the second position, bent away from the pneumatic port, when the water pressure falls below the preselected minimum, thereby disabling the switch.

It will be appreciated from the foregoing that the present invention represents a significant improvement over water level safety devices previously available for use in spas and hot tubs. In particular, the invention provides for disabling of an air-actuated switch without electrically sensing the water level, and provides a useful adjunct to air-actuated switches already installed for the control of spa pump motors. Other aspects and advantages of the invention will become apparent from the following more detailed description, taken in conjunction with the accompanying drawings.

BRIEF DESCRIPTION OF THE PREFERRED EMBODIMENT

Figure 1:
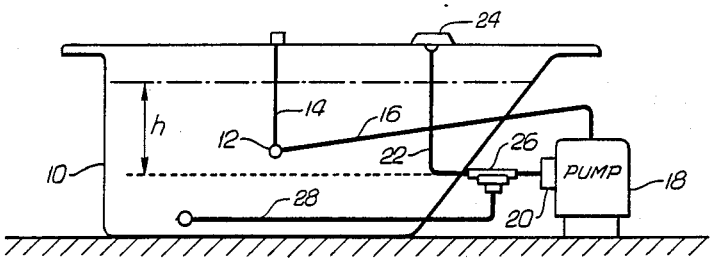
FIG. 1 is a schematic elevational view showing the device of the invention installed in a hot-water tub.

As shown in the drawings for purposes of illustration, the present invention concerns a liquid level sensing device intended principally for use with spas and hot tubs. For safety reasons, water pumps that force water and air into spas are now typically operated by air-actuated switches, to provide electrical isolation from the wet environment, and to permit safe operation by a user still immersed in water. The sensing of an adequate water level for the pump to be safely operated is another function that would be best performed without electrical wiring in or near the water.

In accordance with the present invention, the sensing of water level is performed non-electrically and a low water level will automatically disable operation of any air-actuated switch used to control the spa pump.

As shown in FIG. 1, a spa tub, indicated by reference numeral 10, is filled with water and includes at least one spa jet 12 in a sidewall of the tub. The jet has an air intake line 14 to atmosphere, or may alternatively have an air pump (not shown), and also has a water line 16 extending to a water pump 18, which draws water from a drain or other intake (not shown) at the bottom of the tub. The pump 18 is controlled by an air-actuated switch 20, to which is connected a control line 22, normally sealed and filled with air, extending to an air button 24 conveniently located at the side of the tub 10. When the air button 24 is depressed, a pressure increase is transmitted along the control line 22 to the switch 20, which is toggled from an "on" to an "off" condition, or vice versa. The technology of air-actuated switches is well known and now widely available for spas and the like.

The present invention provides a convenient technique for disabling this switching function if the water in the spa is below some preselected level. For this purpose, the invention provides a pressure sensing device 26 (FIG. shown in enlarged form in FIGS. 2 and 3. As best shown in FIG. 1, the device 26 is installed in the control line 22 to the air button 24, and also senses water pressure through a water line 28 connected to the water in the tub 10. The water pressure conveyed to the device 26 is equivalent to a head of water h, measured from the surface of the water in the tub to the position of the device 26 below the surface. Basically, the action of the device 26 is to vent the control line 22 when the water pressure falls below a preselected level, corresponding a preselected water surface level in the tub.

Figure 2:
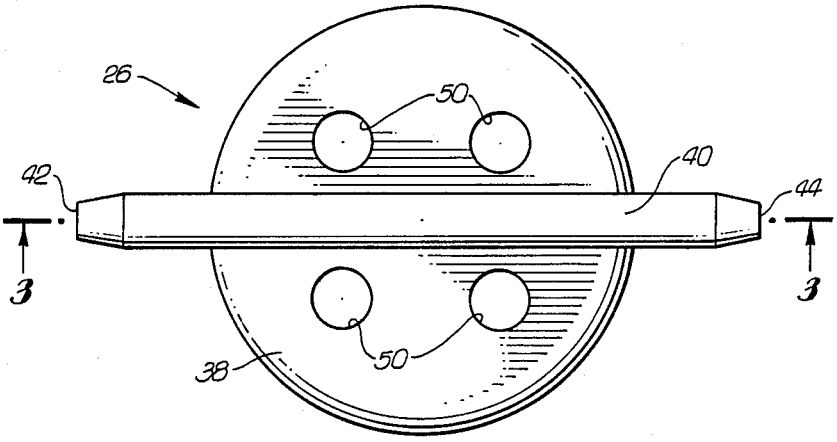
FIG. 2 is a simplified and enlarged plan view of the device of the invention.
Figure 3:
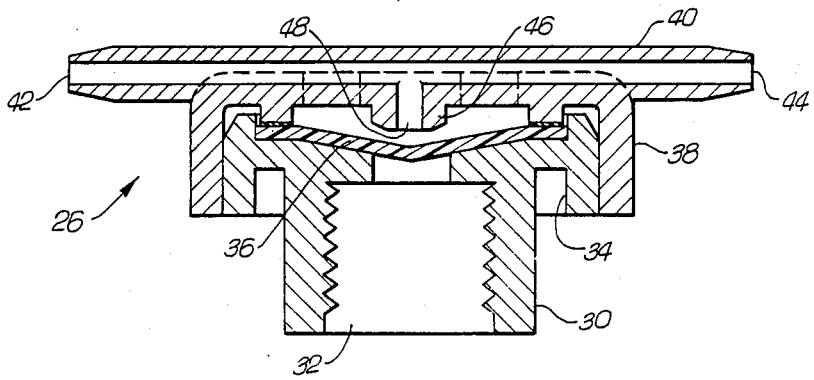
FIG. 3 is a sectional view taken principally along the line 3—3 of FIG. 3.

Details of the construction of the device 26 are shown in FIGS. 2 and 3. Basically it includes a generally cylindrical body 30 to which the water line 28 is connected at one end, indicated at 32. The other end of the body 30 includes a flange 34 on which is mounted a diaphragm 36, shown in a lower position resting on the flanged end of the body. The device further includes a generally circular cap 38, sized to fit over the flanged end of the body 30. In the embodiment shown, the cap 38 is permanently attached to the body by solvent cement, but other structures are within the scope of the invention. The cap 38 supports, or is integral with, an air tube 40 extending diametrically across the cap and having three openings. Two of these are end openings 42 and 44 by means of which the tube is connected in the control line 22 (FIG. 1). The third opening in the tube 40 is formed by a downwardly depending nipple 46 at the center of the cap 38. The nipple 46 presents an opening 48 toward the center of the diaphragm 36.

When there is water in the tub 10, water pressure in the body 30 forces the diaphragm from its lower position illustrated to an upper position in which the opening 48 is sealed by the diaphragm. In this position, air actuation of the pump switch proceeds normally. The water level required for this condition to prevail can be calculated by taking into account the characteristics of the diaphragm, and the force applied to it by the head of water h acting over the effective area of the lower surface of the diaphragm.

If the water level falls below the amount needed to maintain the diaphragm in its upper position, the control line 22 will be vented to atmosphere through the opening 48. It will be noted that the space inside the cap 38 is permanently vented through openings 50.

It will be appreciated from the foregoing that the present invention represents a significant advance in the field of spa and hot tub safety equipment. In particular, the invention provides for the automatic disabling of an air-actuated switch in the event that the water falls below some predetermined level.

It will also be appreciated that, although an embodiment of the invention has been described in detail for purposes of illustration, various modifications may be made without departing from the spirit and scope of the invention. Accordingly, the invention is not to be limited except as by the appended claims.

I claim:

1. A liquid level sensing device, comprising:

a chamber;

a bendable diaphragm installed in the chamber and dividing it into first and second chamber sections;

means for venting the first chamber section to atmosphere;

means for coupling a water pressure to the second chamber section, wherein the diaphragm is bent toward the first chamber section, to a first position, so long as the water pressure in the second chamber section exceeds a preselected minimum, but assumes a second position bent toward the second chamber section when the water pressure falls below the preselected minimum; and a pneumatic port, covered by the diaphragm in its first position but uncovered and vented to atmosphere by the diaphragm in its second position, wherein the pneumatic port is in fluid communication with an air-actuated switch, operation of which is disabled by venting of the port to atmosphere.

2. A liquid level sensing device as defined in claim 1, wherein:

the bendable diaphragm is of the snap-action type.

3. A liquid level device for use in disabling an air-actuated pump motor switch, the device comprising:

an air-filled control line extending between an air-actuated electrical switch and a manually operated plunger;

a normally sealed pneumatic port in fluid communication with the control line, venting of which would disable operation of the switch;

a device body;

a bendable diaphragm installed in the device body, the diaphragm being movable between first and second positions, and having one surface exposed to atmospheric pressure, and in sealing contact with the pneumatic port when the diaphragm is in its first position; and means for coupling a water pressure to the other surface of the diaphragm, wherein the diaphragm is bent to its first position so long as the water pressure exceeds a preselected minimum level, but assumes the second position, bent away from the pneumatic port, when the water pressure falls below the preselected minimum.

* * * * *